US006505356B1

(12) United States Patent
Leonard et al.

(10) Patent No.: US 6,505,356 B1
(45) Date of Patent: Jan. 14, 2003

(54) DISPENSING LIQUIDS

(75) Inventors: Stephen B. Leonard, Franksville, WI (US); Allen D. Miller, Racine, WI (US); Robert E. Corba, Scottsdale, AZ (US); Marilyn M. Johnson, Wauwatosa, WI (US); Steven B. Mineau, Waterford, WI (US); Scott W. Demarest, Caledonia, WI (US); James E. Buhler, Waterford, WI (US); Trevor O. Brown, Somerset (GB)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/719,534

(22) PCT Filed: Jun. 15, 1999

(86) PCT No.: PCT/GB99/01887

§ 371 (c)(1),
(2), (4) Date: Feb. 27, 2001

(87) PCT Pub. No.: WO99/66139

PCT Pub. Date: Dec. 23, 1999

(30) Foreign Application Priority Data

Jun. 15, 1998 (GB) ..... 9812892
Mar. 12, 1999 (GB) ..... 9905828

(51) Int. Cl.[7] ..... E03D 9/02

(52) U.S. Cl. ..... 4/231

(58) Field of Search ..... 4/223, 224, 227.1, 4/231, 309

(56) References Cited

U.S. PATENT DOCUMENTS

| | | | | |
|---|---|---|---|---|
| 597,811 A | | 1/1898 | Calkins | |
| 681,100 A | | 8/1901 | Calkins | |
| RE13,551 E | | 4/1913 | Williams et al. | |
| 1,067,472 A | | 7/1913 | Creed | |
| 1,091,265 A | * | 3/1914 | Wohlander | 4/231 |
| 1,260,082 A | * | 3/1918 | Sleight | 4/309 |
| 1,880,912 A | | 10/1932 | Duwelius | |
| 2,075,266 A | | 3/1937 | Bowman | |
| 3,177,502 A | | 4/1965 | Meunier | |
| 3,529,309 A | | 9/1970 | Leavitt et al. | |
| 3,537,112 A | | 11/1970 | Goodman | |
| 3,604,021 A | | 9/1971 | Nolte | |
| 3,623,941 A | | 11/1971 | Goodenow | |
| 3,639,070 A | | 2/1972 | Davidson | |
| 3,675,254 A | | 7/1972 | Brownstein | |
| 3,736,600 A | | 6/1973 | Drinkwater | |
| 3,766,576 A | | 10/1973 | Ancel | |
| 3,806,965 A | | 4/1974 | Lerner | |
| 3,933,965 A | | 1/1976 | Gallone et al. | |

(List continued on next page.)

FOREIGN PATENT DOCUMENTS

| | | |
|---|---|---|
| CA | 1130763 | 8/1982 |
| DE | 12 86 972 | 1/1969 |
| DE | 25 23 849 | 12/1975 |
| DE | 89 02509.1 | 10/1989 |
| EP | 538957 | 4/1993 |
| EP | 785315 | 7/1997 |
| FR | 2647483 A1 | 11/1990 |
| GB | 296338 | 8/1928 |
| WO | WO 99/10122 A1 | 9/1990 |
| WO | 94/07607 | 4/1994 |
| WO | 96/11850 | 4/1996 |

*Primary Examiner*—Robert M. Fetsuga

(57) ABSTRACT

A liquid dispenser comprises a housing and a hook for suspending the housing from the rim of a lavatory bowl. A user inserts a sealed inverted reservoir bottle into the housing, which breaks the seal. A plate located in the housing conveys liquid from the bottle to a position within the stream of flushing water. The plate can be adjusted to accommodate different lavatories. To allow venting of the bottle, small vent holes are formed in the plate. The plate may have a number of raised holes or elongate slots. A vent system for the bottle is also provided.

108 Claims, 14 Drawing Sheets

U.S. PATENT DOCUMENTS

| | | | | | |
|---|---|---|---|---|---|
| 3,946,448 | A | * | 3/1976 | Sioufy | 4/231 X |
| 4,096,593 | A | | 6/1978 | Vlahakis | |
| 4,228,928 | A | | 10/1980 | Hocker et al. | |
| 4,261,957 | A | | 4/1981 | Schimanski | |
| 4,301,556 | A | | 11/1981 | Schimanski | |
| 4,349,988 | A | | 9/1982 | Kotula et al. | 47/1.5 |
| RE32,017 | E | | 11/1985 | Hautmann et al. | |
| 4,555,819 | A | | 12/1985 | Weiss et al. | |
| 4,722,449 | A | | 2/1988 | Dubach | 215/235 |
| 4,777,670 | A | | 10/1988 | Klinkhammer et al. | |
| 4,813,084 | A | | 3/1989 | Buecheler et al. | |
| 4,913,350 | A | | 4/1990 | Purzycki | |
| 4,916,760 | A | | 4/1990 | Shahar | |
| 5,186,912 | A | | 2/1993 | Steindorf et al. | |
| 5,261,755 | A | | 11/1993 | Draper et al. | |
| 5,472,143 | A | | 12/1995 | Bartels et al. | 239/462 |
| 5,547,094 | A | | 8/1996 | Bartels et al. | 216/33 |
| 5,657,065 | A | | 8/1997 | Lin | |
| 5,901,886 | A | | 5/1999 | Grindstaff et al. | |
| 5,911,851 | A | | 6/1999 | Bartels et al. | 156/345 |
| 6,230,334 | B1 | | 5/2001 | Camp et al. | |

* cited by examiner

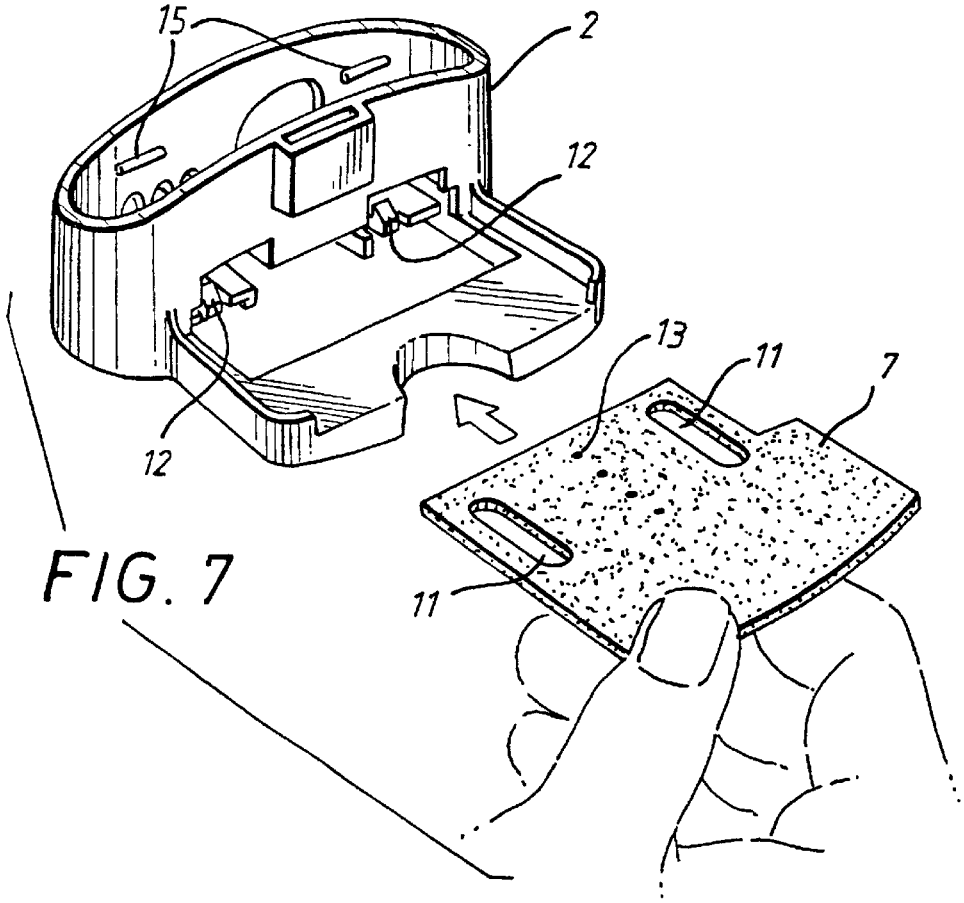
FIG. 7
FIG. 11
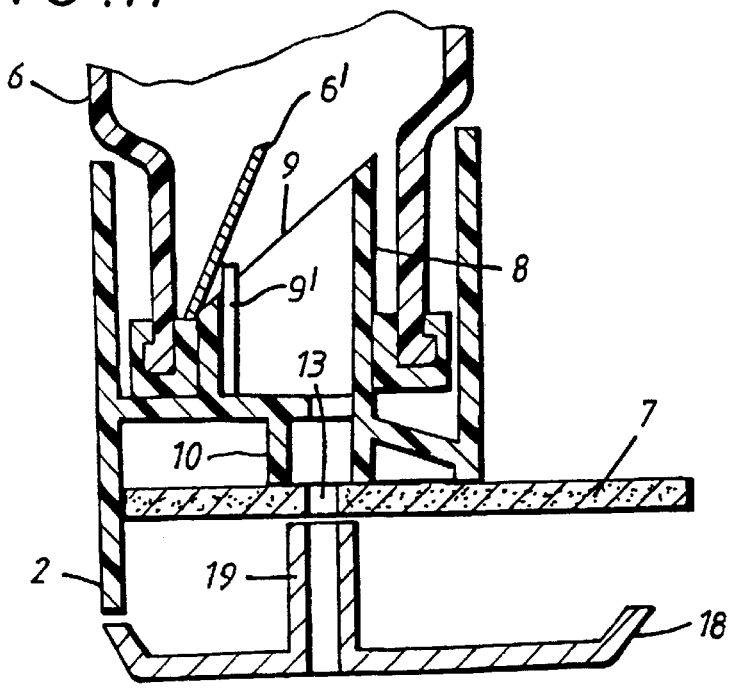

FIG. 17(a)
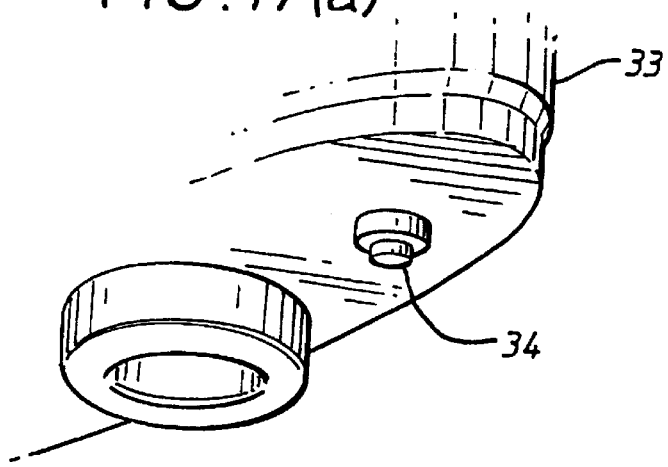
FIG. 17(b)
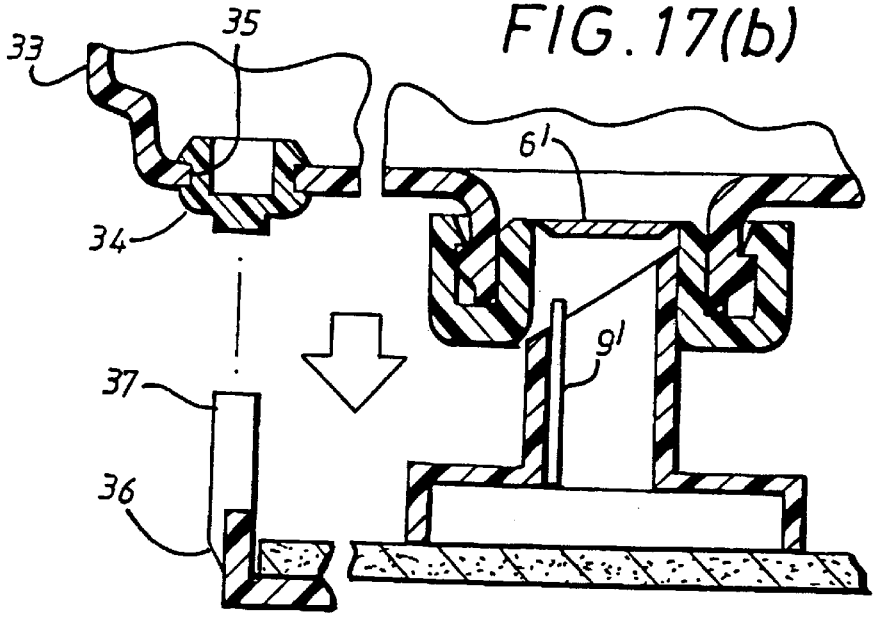
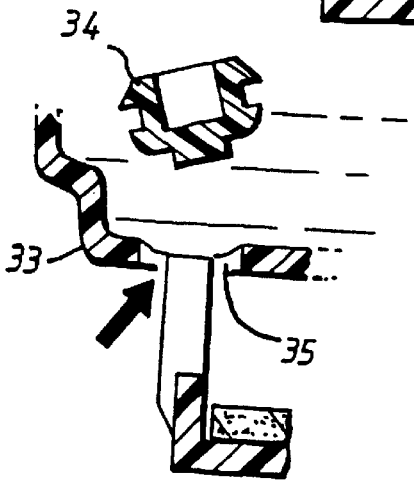
FIG. 17(c)

FIG. 18(a)
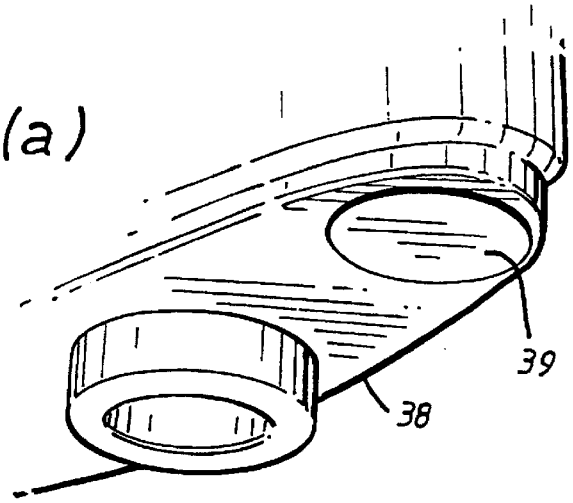
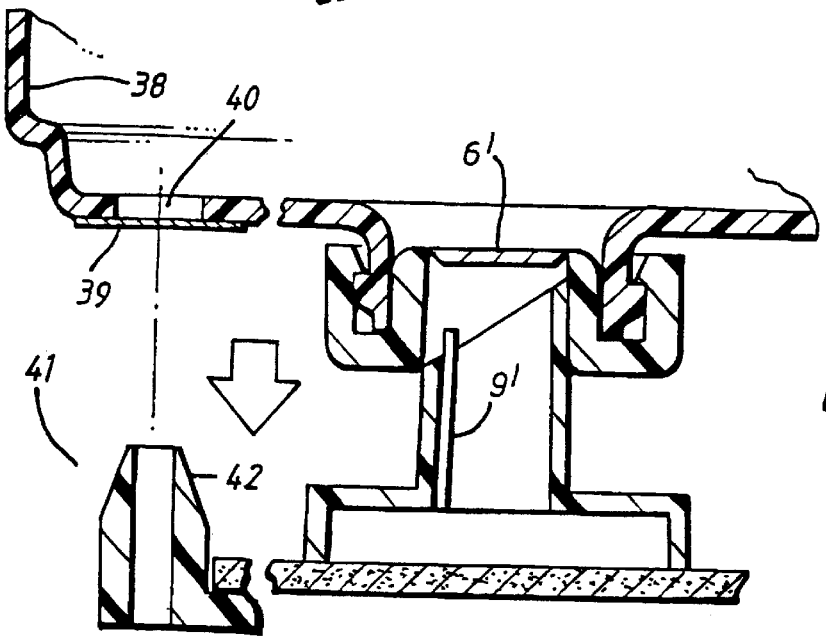
FIG. 18(b)
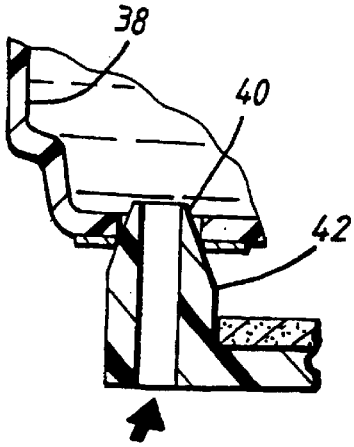
FIG. 18(c)

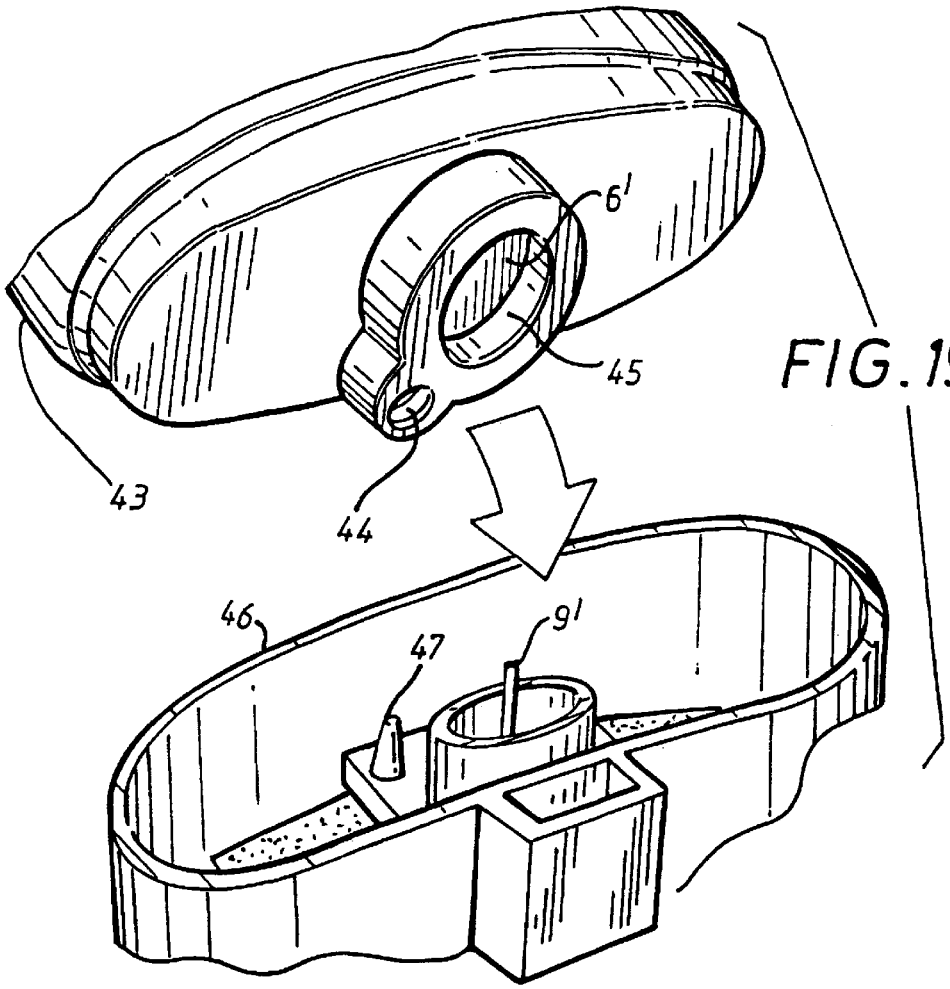
FIG. 19(a)
FIG. 19(b)
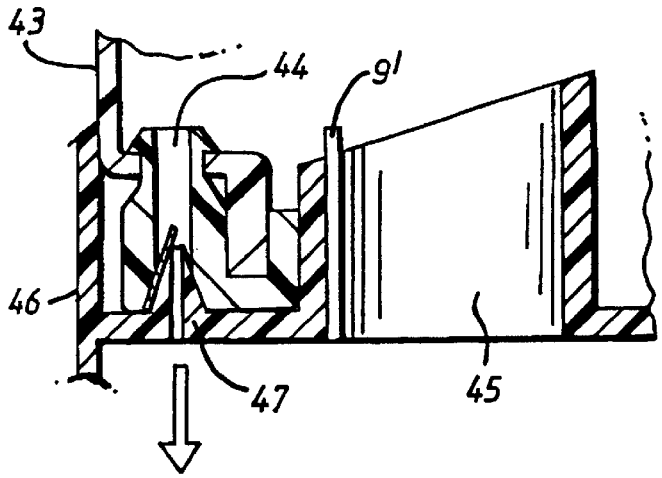

FIG. 20(a)
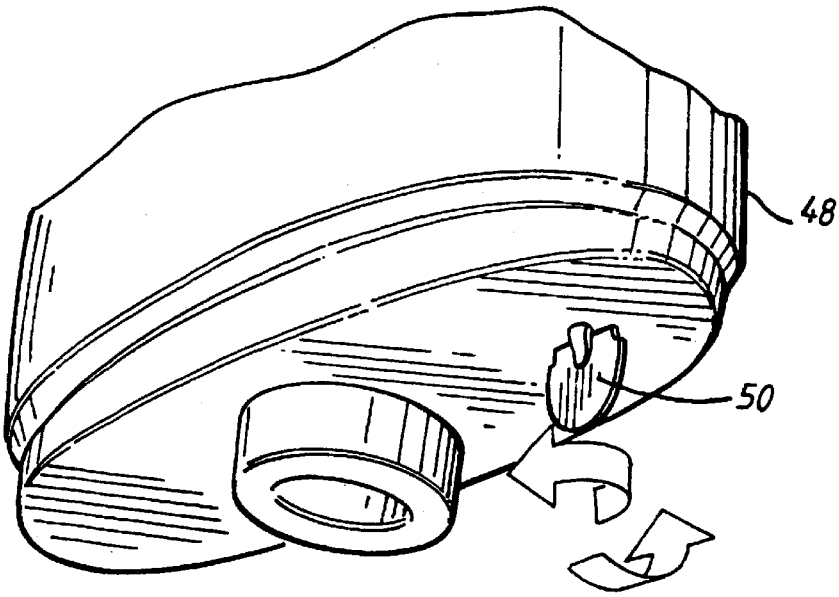
FIG. 20(b)
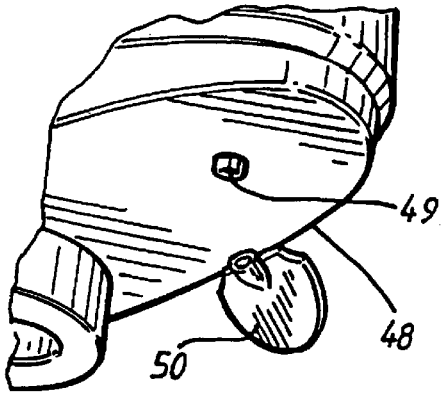
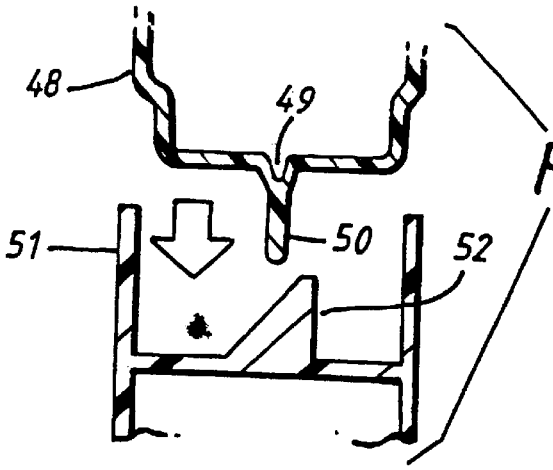
FIG. 20(c)

DISPENSING LIQUIDS

The present invention relates to liquid dispensers and in particular to arrangements for dispensing quantities of liquids, such as cleaning and/or refreshing liquids, from the rim of a lavatory bowl. Such dispensers typically comprise a reservoir in the form of an inverted bottle, which supplies the liquid to a wicking device, such as a porous pad.

One known device of this type is described in published European patent application EP-A-0 785 315. This application acknowledges the problem with such devices that as the liquid level in the bottle falls the rate at which liquid is dispensed falls with time and thereby renders the dispenser less effective.

The solution to this problem suggested by the above reference is to provide a structure between the mouth of the bottle and the wicking device so as to permit both the flow of the liquid from the bottle to the wicking device and also a return flow of air from outside the dispenser to the bottle.

However, the proposed structure is complex and therefore expensive to manufacture. Furthermore, a given dispenser of the type described in this reference can function only with a lavatory system having a predefined relative position of the rim of the lavatory bowl and the stream of flushing water.

A further problem with prior-art liquid dispensers of this type is that, when the consumer causes the bottle to be opened, e.g. by inserting the inverted bottle in a dispensing unit, some of the liquid spurts out as a result of the liquid in the bottle being slightly above atmospheric pressure, possibly because the act of sealing the mouth of the bottle in the factory pressurises the liquid to some extent.

It would therefore be desirable to provide liquid dispensers and methods of filling bottles for such dispensers which overcome, or at least mitigate, one or more of the above disadvantages of the prior-art dispenser.

In accordance with a first aspect of the present invention there is provided a liquid dispensing device as defined in claim 1.

In accordance with a second aspect of the present invention there is provided a housing as defined in claim 14.

In accordance with a third aspect of the present invention there is provided a liquid dispensing unit as defined in claim 15.

The wicking device is preferably provided with at least one venting aperture, which when the device is adjustable, are positioned such that there is at least one functioning venting hole for every possible functional position of the adjustable wicking device.

A spillage tray is advantageously positioned in use below the wicking device having formed therein a vent channel arranged in communication with the at least one functioning venting aperture.

In accordance with a fourth aspect of the present invention there is provided a liquid dispensing unit as defined in claim 19.

In accordance with a fifth aspect of the present invention there is provided a dispensing unit as defined in claim 20.

The or each venting aperture may be in the form of a substantially circular hole or an elongate slit.

The unit is preferably so structured as to permit the position of the wicking device to be adjusted between different positions so as to function with lavatory bowls with different shapes and different flushing systems.

The dispensing unit preferably further comprises a conduit for conveying liquid from the reservoir to the wicking device. The conduit may comprise a cylindrical inlet portion of substantially circular cross-section for engaging the circular mouth of a bottle constituting the reservoir and preferably terminates obliquely so as to define a substantially elliptical aperture. The conduit may further comprise a substantially cylindrical outlet portion, e.g. of a D-shaped, circular or substantially rectangular cross-section, having a cross-sectional area substantially less than that of the inlet portion, and the inlet portion of the conduit may be laterally displaced from the outlet portion. Such an arrangement is geometrically particularly advantageous when an adjustable wicking device is provided. When the outlet portion has a D-shaped cross-section, the bar of the "D" can be arranged to coincide with a diameter of the substantially circular inlet portion of the conduit when viewed vertically. The outlet portion of the conduit bears against the wicking device so as to create a substantially liquid-tight seal therebetween.

The outlet portion is preferably at least partially surrounded by a barrier wall, which may be cylindrical and of rectangular cross-section. This serves to prevent ingress of flushing water into the reservoir.

The wicking device preferably comprises a first portion for receiving liquid from the reservoir and a second portion arranged to be positioned in use in a dispensing position. The second portion may be arranged to be positioned in use within the stream of flushing water, in which case the second portion is preferably arranged to be positioned in use between the first portion and the rim of the lavatory bowl.

The dispensing unit is preferably structured such that the position of the wicking device can be adjusted by sliding the first portion thereof against the outlet portion of the conduit.

The wicking device is preferably substantially laminar and may be formed with a depression for receiving the neck of a bottle constituting a said reservoir. The wicking device may be formed with one or more elongate apertures and the housing may comprise a corresponding one or more projections for engaging the elongate apertures so as to define the outermost possible operative position of the wicking device. In this case, the or each projection may comprises a spring finger which is arranged to engage its corresponding aperture in the wicking device when the wicking device is inserted into the housing.

The wicking device may comprise a projection for insertion in the mouth of a said reservoir in use, the projection having formed therethrough a vent channel.

The wicking device preferably comprises a porous pad but may alternatively comprise a plate with channels or circular holes formed therein. The channels may be formed as elongate apertures or elongate channels within the plate and may be arranged in a splayed configuration thereby to convey the liquid from the reservoir in divergent paths. The invention extends to the combination of such a dispensing unit and means for suspending the unit from the rim of a lavatory bowl.

The invention extends to the combination of such a dispensing unit, which is provided with a conduit having an inlet portion of substantially circular cross-section, and a bottle constituting the reservoir, the bottle comprising an opening for dispensing the liquid therefrom, the opening having a substantially circular cross-section greater than that of the inlet portion of the conduit, the opening and the inlet portion of the conduit preferably being so dimensioned as to form a substantially liquid-tight seal when the cylinder is inserted in the reservoir mouth.

The mouth of the bottle is covered prior to use with a frangible seal which is arranged to be broken in use by compressing the seal against the circular inlet portion of the conduit. Such an arrangement is particularly convenient for the user. The cylindrical inlet portion of the conduit preferably comprises opening means for causing the frangible seal to be so broken and retaining means for retaining the frangible seal in a position which does not block the mouth of the bottle.

The seal is preferably substantially rigid and arranged to be pivoted between open and closed positions about one side thereof, the angle through which the seal is moved between said open and closed positions being substantially 90 degrees. The opening means may comprise a projection arranged to bear on the side of the closure member generally opposite to this one side. The retaining means may comprise a further projection arranged to bear on a face of the closure member when in its open position.

The seal is preferably substantially circular, and the opening means and the retaining means may be disposed at diametrically opposed positions in relation to the seal. The opening means and the retaining means may be formed on a substantially circular obliquely truncated cylinder which is arranged to be inserted into the mouth of the reservoir to cause the seal to move into its open position. The opening means may comprise the end portion of the obliquely truncated cylinder. The retaining means may comprise a projection from the cylinder, such as a stud.

The invention extends to the combination of such a dispensing unit and bottle and means for suspending the unit and the bottle from the rim of a lavatory bowl.

In accordance with a sixth aspect of the present invention there is provided a liquid dispensing unit as defined in claim 64.

In accordance with a seventh aspect of the present invention there is provided a dispensing unit as defined in claim 65.

The venting means may comprise a one-way valve, such as a duck-bill valve.

Alternatively, the venting means may comprise a removable plug, and said unit may comprise a co-operating projection which is positioned so as to remove the plug when the reservoir bottle is placed by a user in its operative position in relation to the unit, thereby to create a venting aperture in the reservoir bottle.

In a further arrangement, the venting means may comprise a removable seal, and said unit may comprise a co-operating hollow projection which is positioned so as to remove the seal and project into the reservoir bottle when the reservoir bottle is placed by a user in its operative position in relation to the unit, the hollow projection constituting a venting channel.

In a yet further arrangement, the venting means may comprise an air vent in the reservoir bottle which is sealed by a cover portion which either can be removed by a user prior to use or is automatically removed by a projection arranged on the unit so as to remove the cover portion when the reservoir bottle is placed by a user in its operative position in relation to the unit.

The invention extends to a method of filling and sealing a dispenser bottle for use as a reservoir within such a dispensing unit, the method comprising heating the liquid prior to sealing the reservoir bottle so as to create a partial vacuum within the bottle when the liquid cools to room temperature. Alternatively, or in addition thereto, the bottle may be compressed after filling the bottle with the liquid, and the bottle sealed while compressed so as to create a partial vacuum within the bottle after sealing.

The invention further extends to a liquid-dispensing device comprising a liquid reservoir having a mouth and a closure member arranged, when in its closed position, to seal the mouth and which can be moved into an open position, in which liquid can be dispensed from the reservoir, the device further comprising opening means for causing the closure member to be so moved into said open position and means for retaining said closure member in its open position.

Such an arrangement enables liquid to be dispensed from the reservoir, once opened, while preventing the closure from returning to its closed position, e.g. by the weight of the liquid remaining in the reservoir in the case of an inverted reservoir.

The closure member is preferably substantially rigid and arranged to be pivoted between said open and closed positions about one side thereof. The angle through which the closure member is moved between said open and closed positions may be substantially 90 degrees. This reduces the force exerted by the weight of the liquid remaining in the reservoir on the closure member, in the case of an inverted reservoir.

The opening means preferably comprises a projection arranged to bear on the side of the closure member generally opposite to said one side, and the retaining means preferably comprises a further projection arranged to bear on a face of the closure member when in its open position.

The closure member may be substantially circular, and the opening means and the retaining means are then preferably disposed at diametrically opposed positions in relation to the closure member.

The opening means and the retaining means are preferably formed on a substantially circular obliquely truncated cylinder which is arranged to be inserted into the mouth of the reservoir to cause the closure member thereof to move into its open position. In this case, the opening means preferably comprises the end portion of the obliquely truncated cylinder, and the retaining means comprises a projection from the cylinder in the form of a stud.

The cylinder and the reservoir mouth are preferably so dimensioned as to form a substantially liquid-tight seal when the cylinder is inserted in the reservoir mouth.

The opening means and the retaining means conveniently form part of a housing for the reservoir, and housing may comprise means for suspending the device such that, when the opening means and the retaining means are inserted in the reservoir mouth, the reservoir is supported in an inverted position with the mouth lowermost, such that the liquid can be dispensed from the reservoir. For example, the device may be arranged to be suspended from the rim of a lavatory, and the liquid may be a cleansing and/or refreshing liquid.

The invention further extends to a housing for a liquid reservoir having a mouth and a closure member arranged, when in its closed position, to seal the mouth and which can be moved into an open position, in which liquid can be dispensed from the reservoir, said housing comprising opening means for causing the closure member to be so moved into said open position and means for retaining said closure member in its open position.

The invention further extends to a liquid-dispensing unit comprising a housing containing a plate having channels formed therein for conveying liquid to be dispensed from a reservoir to a dispensing position.

In a further aspect, the present invention provides a dispensing unit as defined in claim 74.

The plate is preferably so retained in a generally horizontal plane.

In a preferred embodiment, the plate has a first portion for receiving liquid from a said reservoir and a second portion intended to be positioned within the stream of flushing water, wherein the second portion of the plate terminates in a curved edge. The second portion may be formed with a wall.

The capillary channels may be arranged in a substantially parallel fashion, and the plate may be formed with a recess extending transversely to the direction of the channels. The recess preferably communicates with the channels, the bottom of the recess being preferably substantially planar, with preferably no capillary channels formed therein.

The plate may comprise a projection for insertion in the mouth of the reservoir, the projection preferably being in the form of a post provided with a plurality of radial fins which define conduits for the liquid between the reservoir and the plate.

Preferred embodiments of the invention will now be described with reference to the accompanying drawings, in which.

Figure 1:
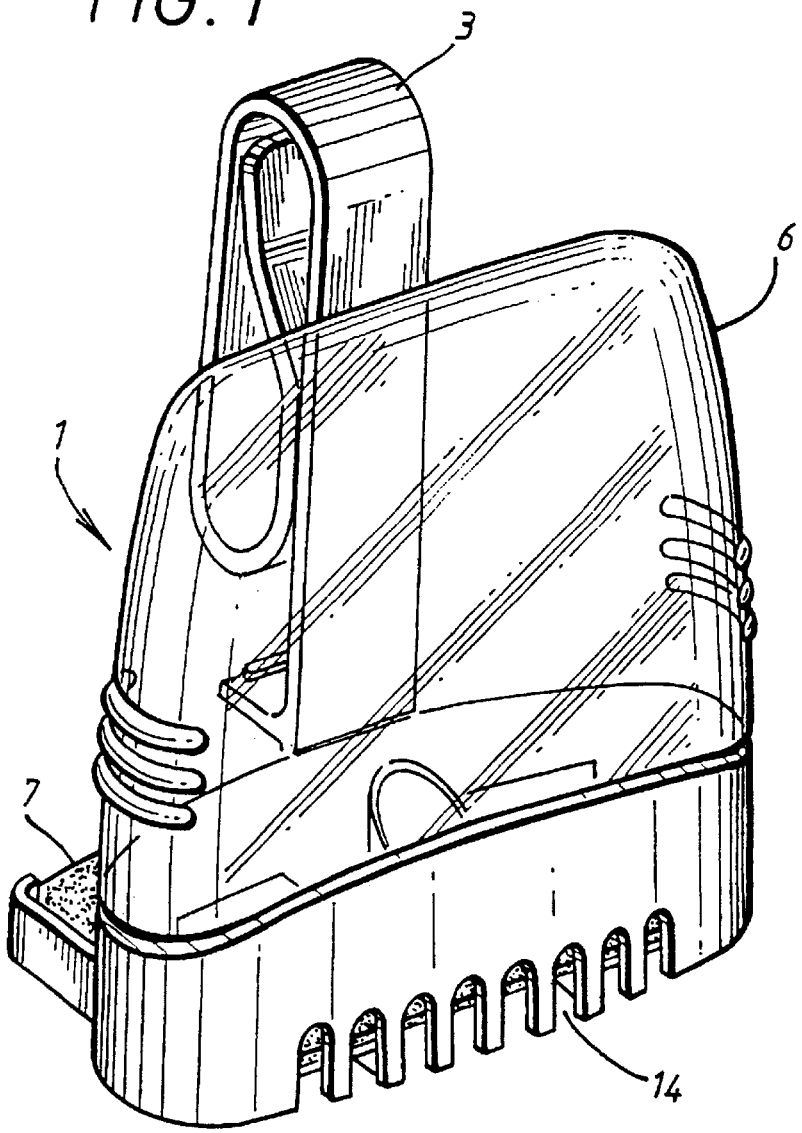
FIG. 1 is a perspective view of a liquid dispenser in accordance with a preferred embodiment of the present invention.
Figure 3:
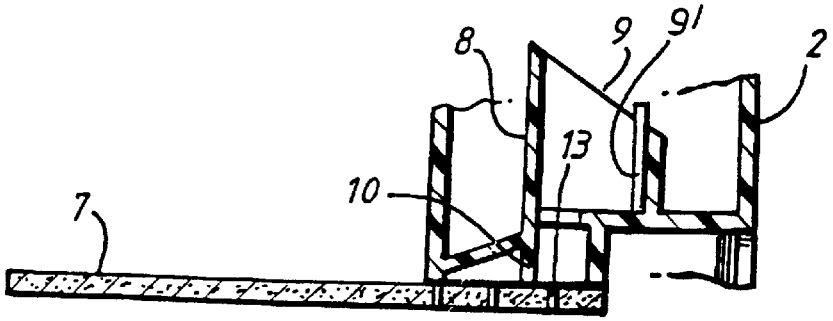
FIG. 3 is a detail of the cross-sectional view of FIG. 2 in a different configuration and without the reservoir bottle.
Figure 2:
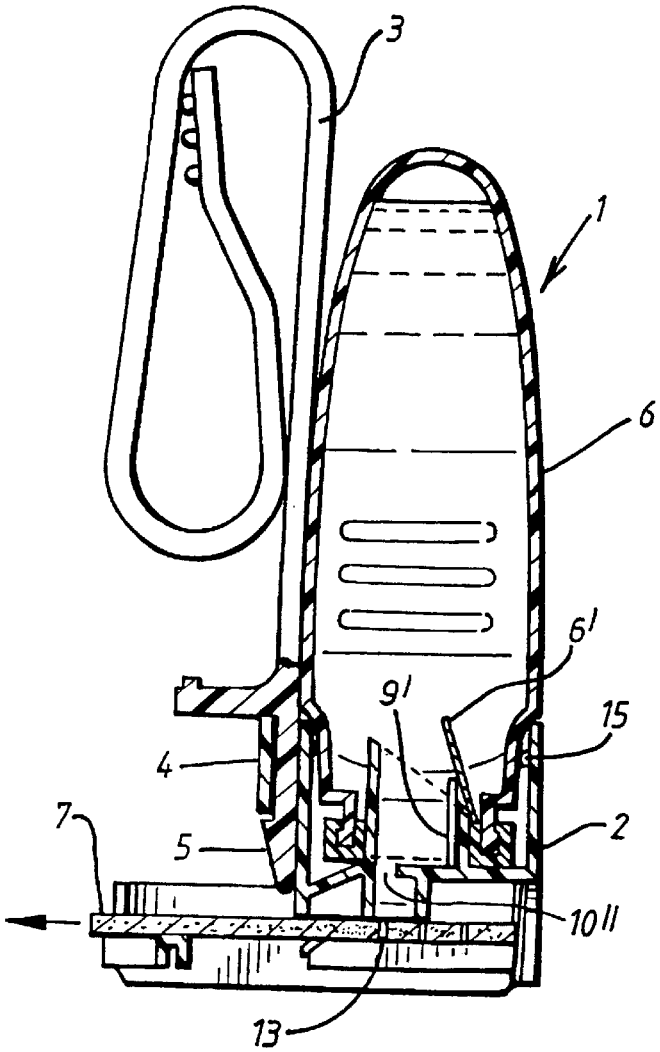
FIG. 2 is a cross-sectional view of the embodiment shown in FIG. 1.
Figure 4:
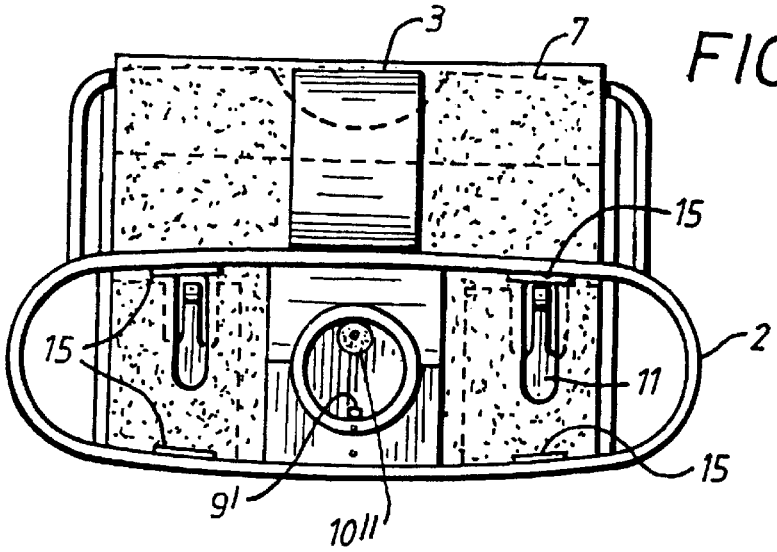
FIG. 4 is a plan view of the embodiment shown in FIGS. 1 to 3 but without the reservoir bottle.
Figure 4A:
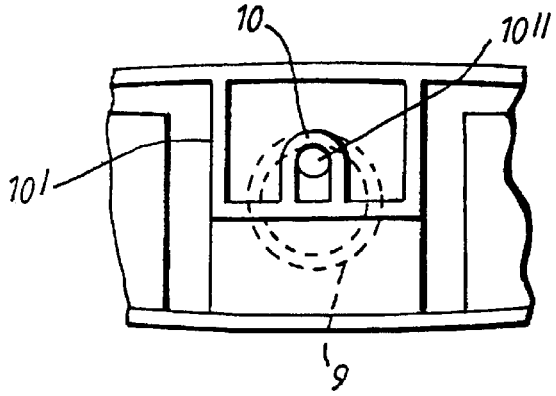
Figure 4B:
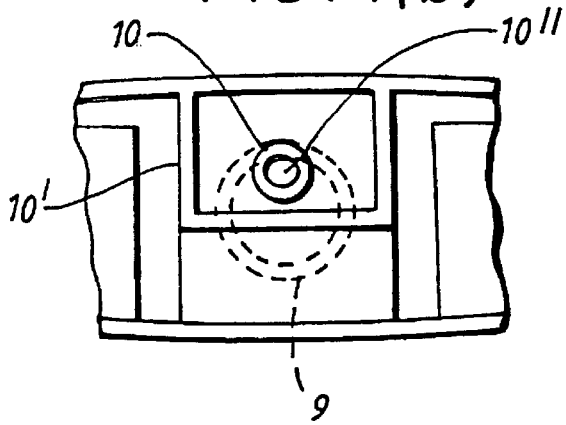
Figure 4C:
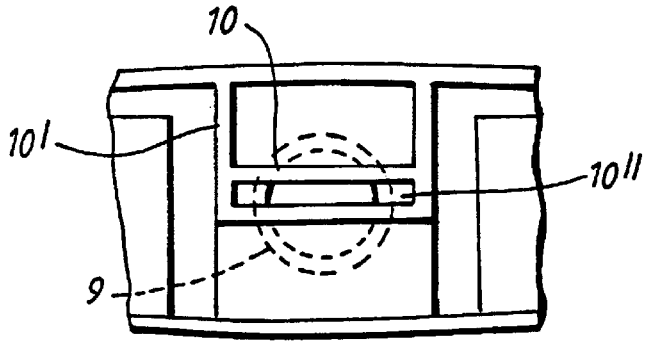
Figure 6:
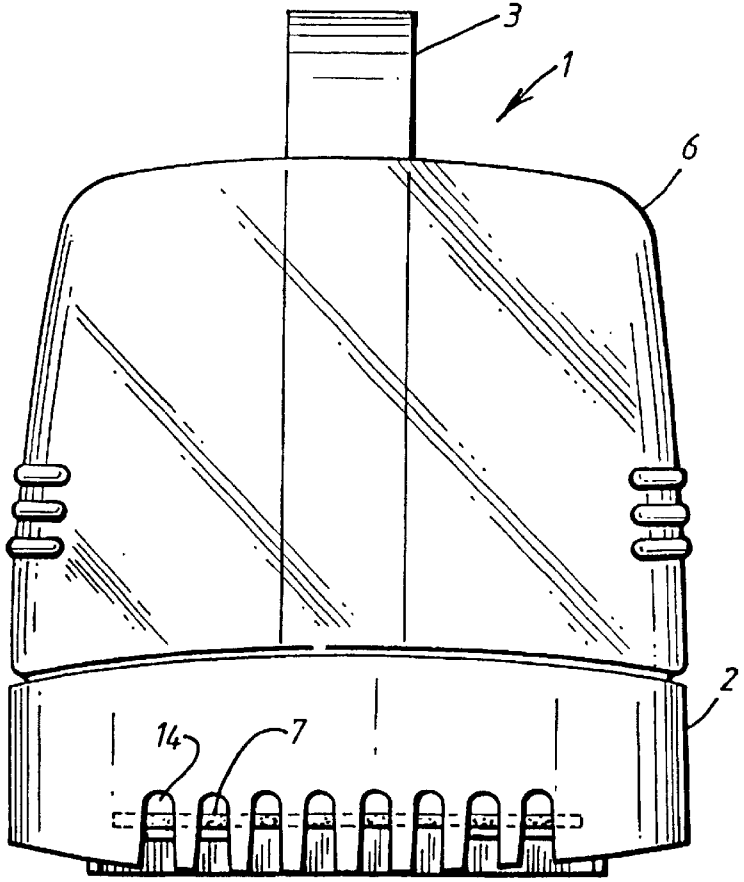
Figure 5:
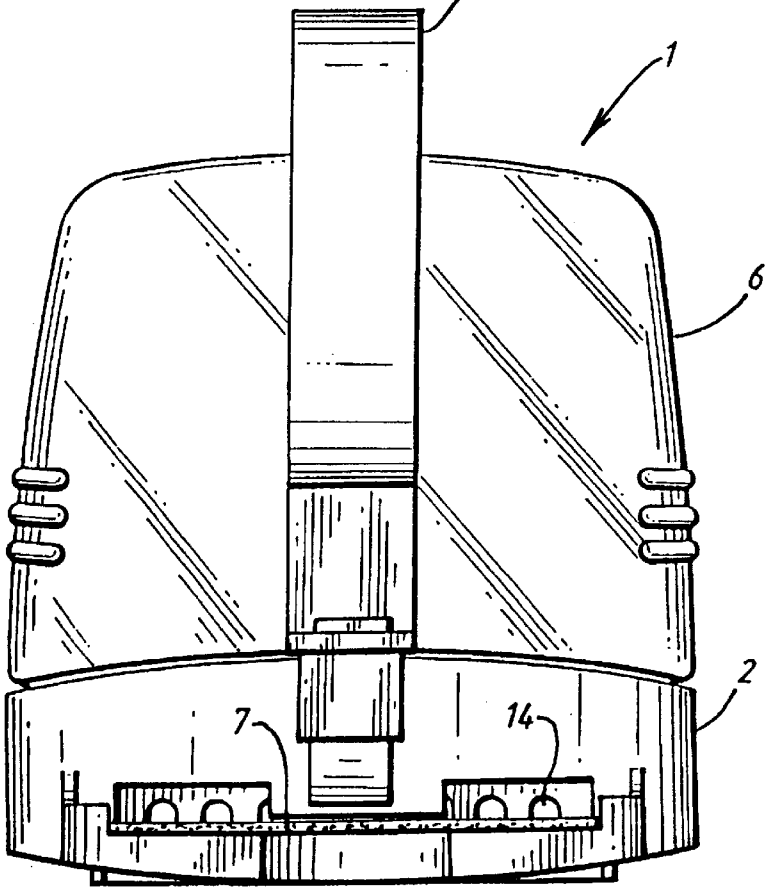
Figure 8:
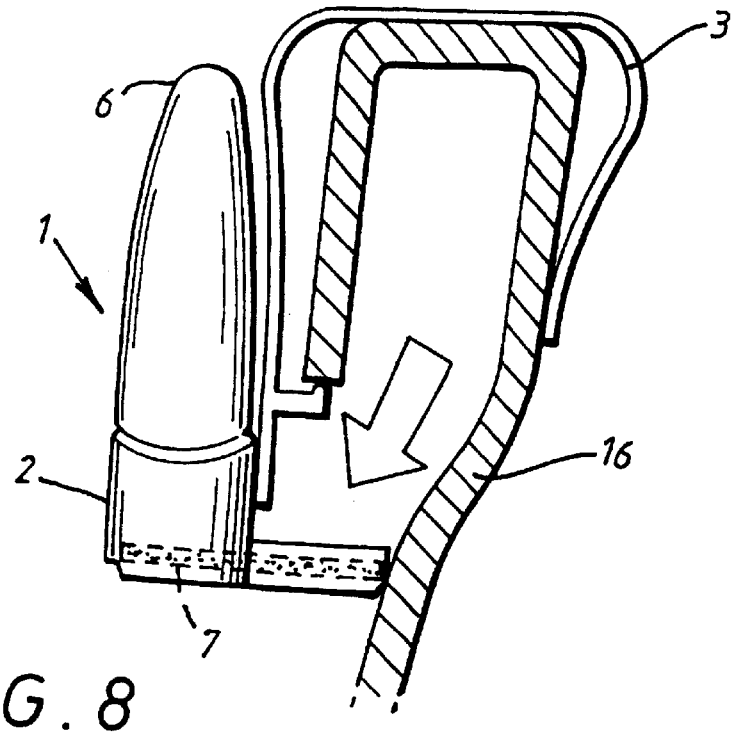
Figure 9:
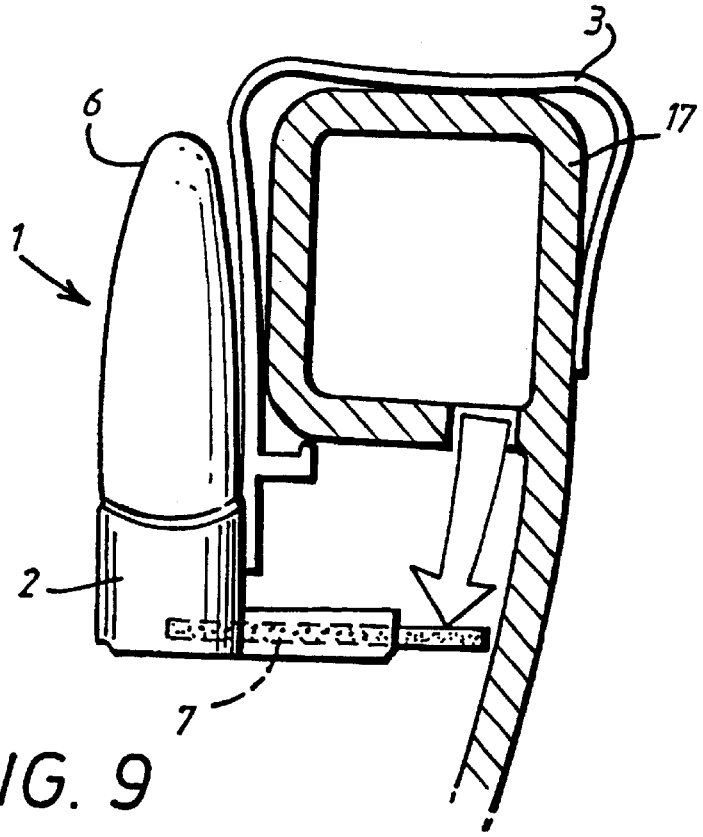
Figure 10:
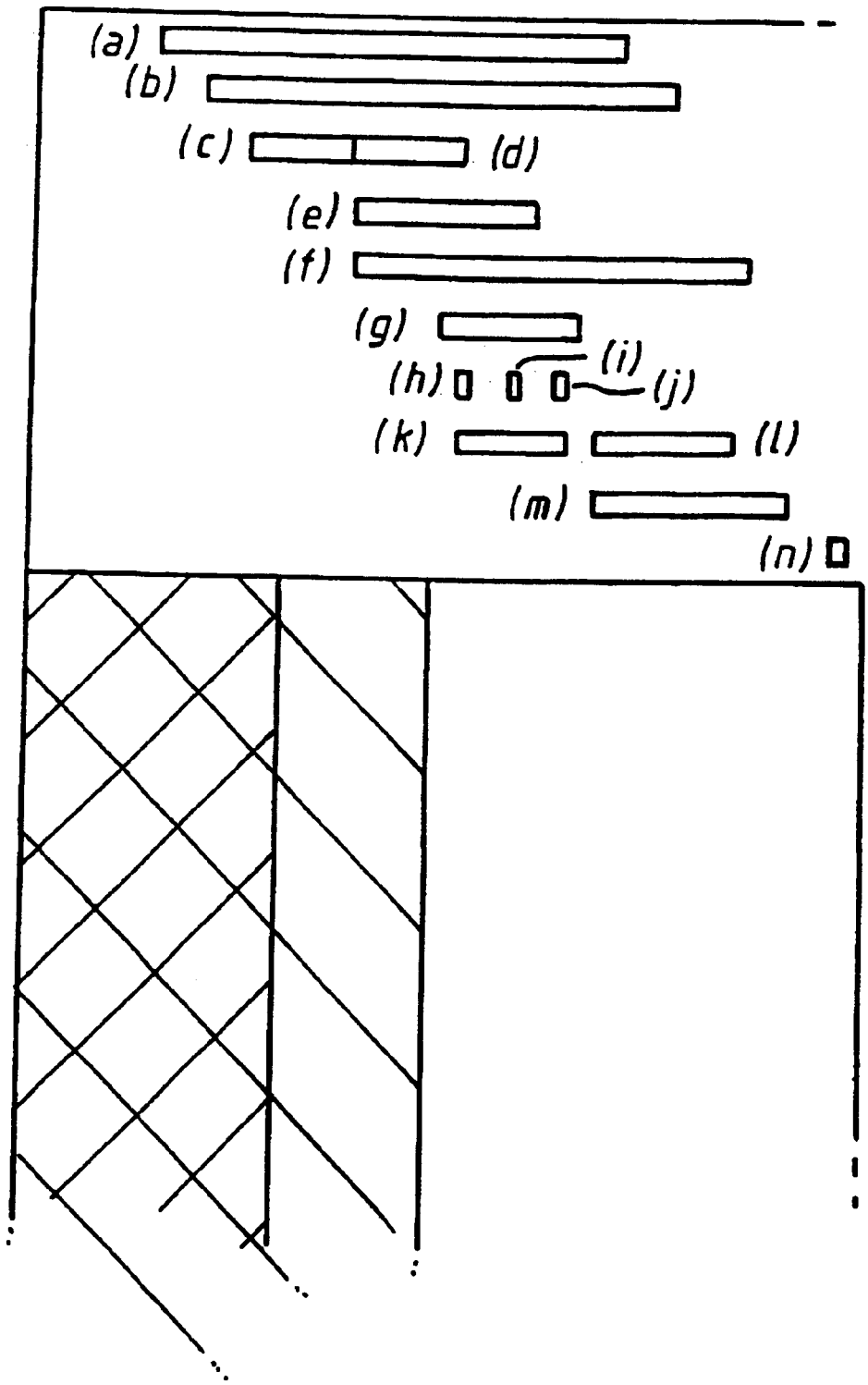
Figure 12A:
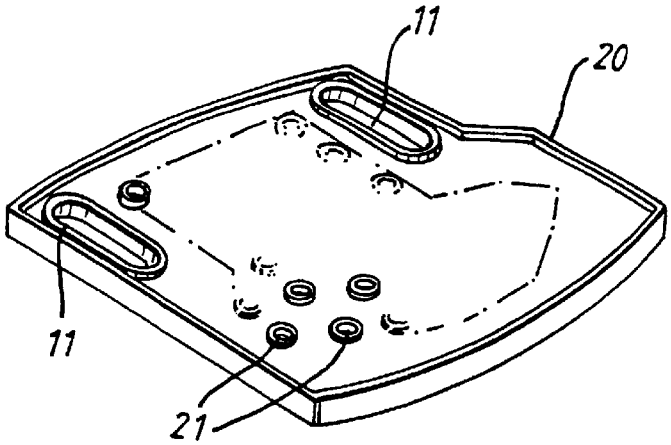
Figure 12B:
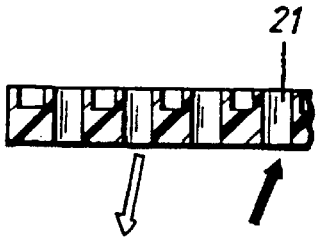
Figure 13A:
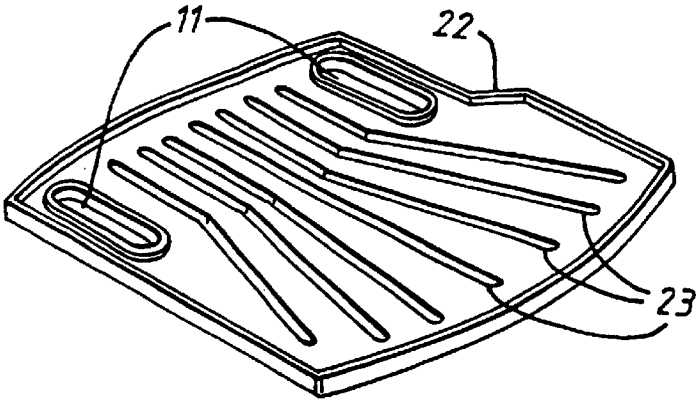
Figure 13B:
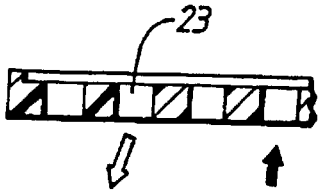
Figures 14A, 14B, 15A:
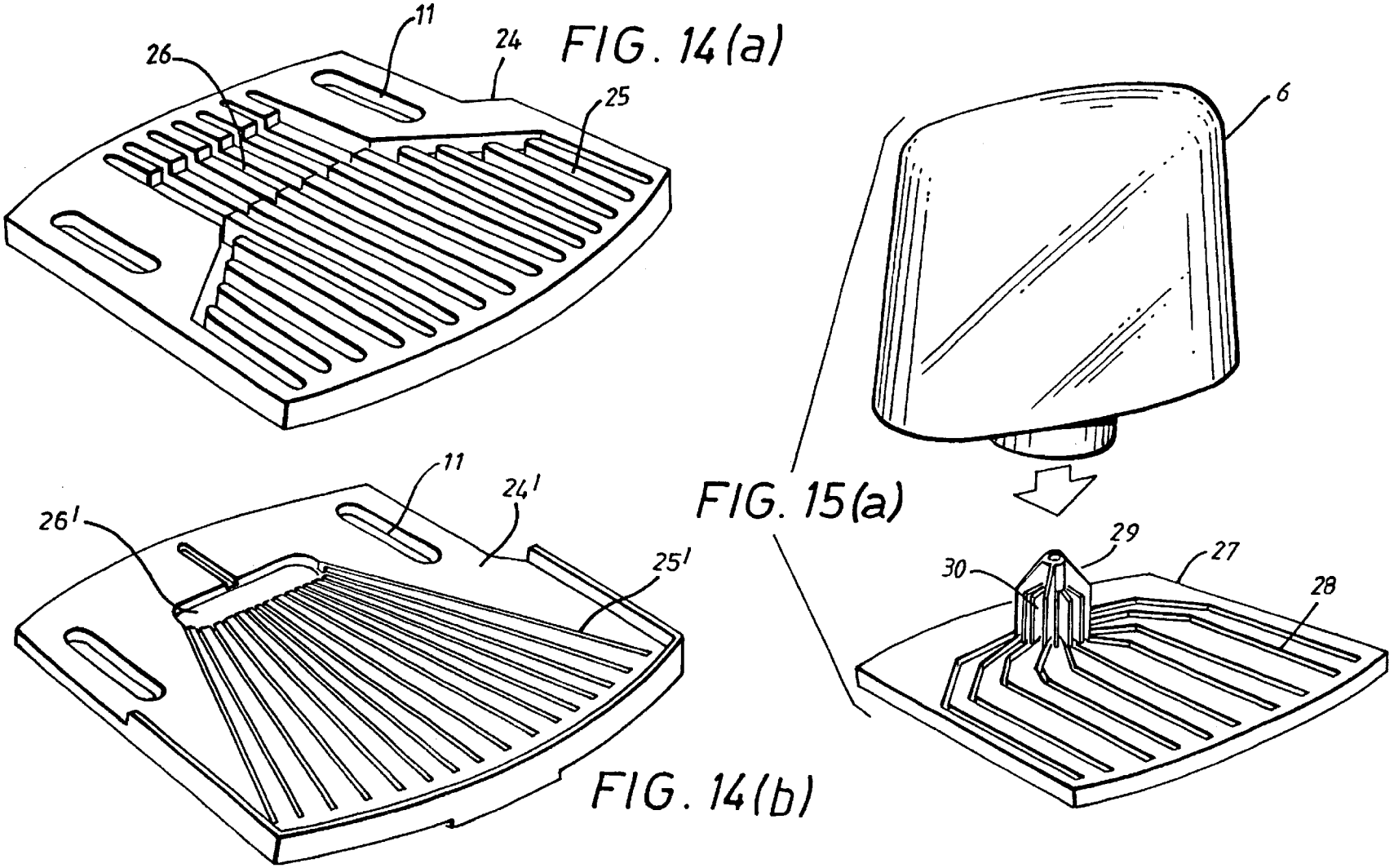
Figure 15B:
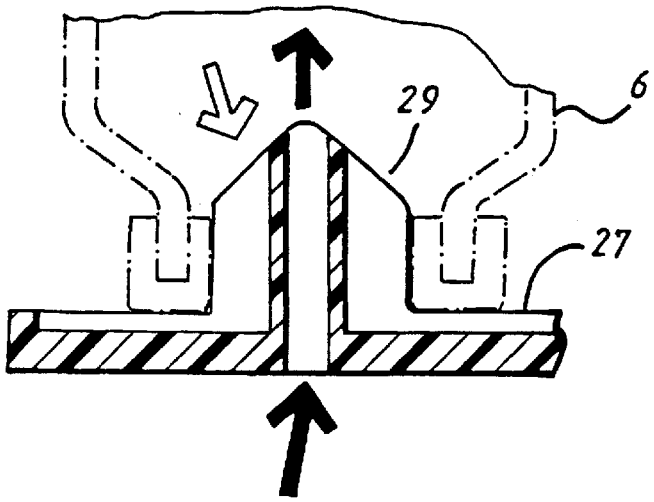
Figure 16A:
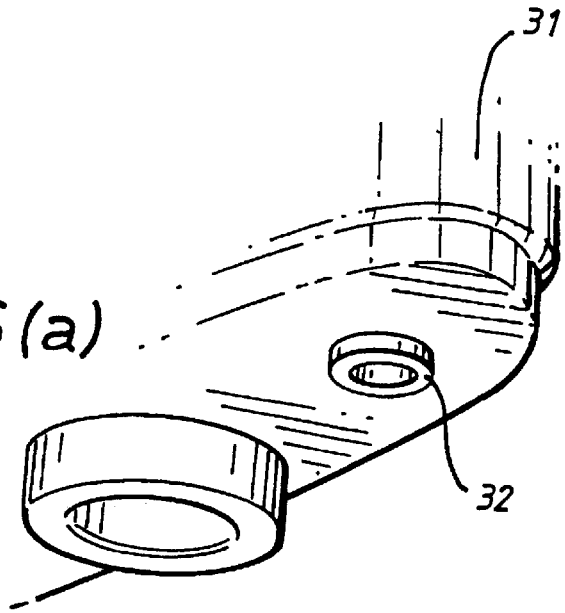
Figure 16B:
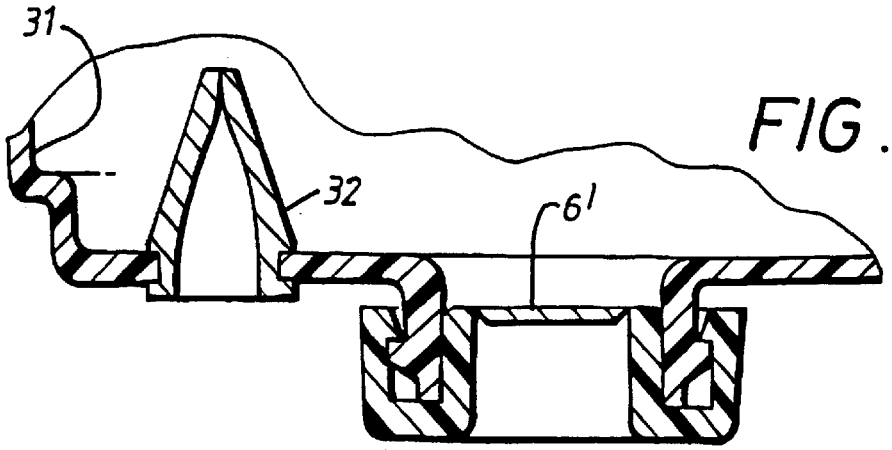

FIGS. 4(*a*) to (*c*) illustrate plan views from underneath of three different structures of the outlet portion;

FIG. 5 is a front view of the liquid dispenser of FIGS. 1 to 4;

FIG. 6 is a rear view of the liquid dispenser of FIG. 1 to 5;

FIG. 7 illustrates schematically the manner in which a porous pad may be inserted into the housing of a liquid dispenser of the preferred embodiment;

FIG. 8 illustrates schematically the relative position of the dispensing device of the preferred embodiment and a lavatory rim from which the device is suspended;

FIG. 9 illustrates schematically the relative position of the dispensing device of the preferred embodiment in another configuration and a different lavatory rim from which the device is suspended;

FIG. 10 is a chart illustrating different types of lavatory flushing arrangements;

FIG. 11 illustrates an optional arrangement of a spillage tray and vent channel for use with the preferred embodiment;

FIG. 12(*a*) illustrates a first alternative structure for the wicking device of the liquid dispenser shown in FIGS. 1 to 10;

FIG. 12(*b*) is a cross-sectional view of the wicking device shown in FIG. 12(*a*);

FIG. 13(*a*) illustrates a second alternative structure for the wicking device of the liquid dispenser shown in FIGS. 1 to 10;

FIG. 13(*b*) is a cross-sectional view of the wicking device shown in FIG. 13(*a*);

FIGS. 14(*a*) and (*b*) illustrate respectively third and fourth alternative structures for the wicking device of the liquid dispenser shown in FIGS. 1 to 10;

FIG. 15(*a*) is a perspective view of a fifth alternative structure for the wicking device in combination with the reservoir bottle of the liquid dispenser shown in FIGS. 1 to 10;

FIG. 15(*b*) is a cross-sectional view of the wicking device and reservoir bottle shown in FIG. 15(*a*);

FIG. 16(*a*) is a perspective view of a first alternative venting arrangement for the liquid dispenser shown in FIGS. 1 to 10;

FIG. 16(*b*) is a cross-sectional view of the venting arrangement shown in FIG. 16(*a*);

FIG. 17(*a*) is a perspective view of a second alternative venting arrangement for the liquid dispenser shown in FIGS. 1 to 10;

FIG. 17(*b*) is a cross-sectional view of the venting arrangement shown in FIG. 17(*a*);

FIG. 17(*c*) is a portion of the cross-sectional view of FIG. 17(*b*) illustrating the release of the venting plug;

FIG. 18(*a*) is a perspective view of a third alternative venting arrangement for the liquid dispenser shown in FIGS. 1 to 10;

FIG. 18(*b*) is a cross-sectional view of the venting arrangement shown in FIG. 18(*a*);

FIG. 18(*c*) is a portion of the cross-sectional view of FIG. 18(*b*) illustrating the breaking of the venting seal;

FIG. 19(*a*) is a perspective view of the top of the reservoir bottle and the housing in a fourth alternative venting arrangement for the liquid dispenser shown in FIGS. 1 to 10;

FIG. 19(*b*) is a cross-sectional view of the venting arrangement shown in FIG. 19(*a*) after insertion of the reservoir bottle in the housing;

FIG. 20(*a*) is perspective view of a fifth venting arrangement for the liquid dispenser shown in FIGS. 1 to 10;

FIG. 20(*b*) is a perspective view of a portion of the reservoir bottle shown in FIG. 20(*a*) showing the cover plate broken away to expose the vent hole; and FIG. 20(*c*) is a cross-sectional view of a sixth venting arrangement, similar to that shown in FIGS. 20(*a*) and 20(*b*) but wherein the cover plate is broken away automatically by a projection on the housing of the liquid dispenser on insertion of the reservoir bottle into the housing.

With reference to FIGS. 1 to 7, a liquid dispenser 1 comprises a housing 2 and a sprung suspension hook 3 for suspending the housing 2 from the rim of a lavatory bowl (not shown). For ease of manufacture, the suspension hook 3 is formed as a separate component from the housing 2, and the housing 2 is formed with an integral guide channel 4 (see FIG. 2) of rectangular cross-section into which the lower end of the suspension hook 3 is inserted during manufacture. The lower end of the suspension hook 3 comprises a raised, chambered portion 5, such that, upon insertion, the hook 3 remains engaged within the channel 4 by a snap-fitting arrangement.

Once the unit is thus suspended, a user inserts in the housing 2 a sealed inverted reservoir bottle 6 into the housing 2. The act of insertion causes the seal on the reservoir bottle 6 to break, in a manner to be described below. A wicking device in the form of a porous pad 7 is located in a slot within the housing 2, and this pad conveys liquid from the reservoir bottle 6 to a position within the stream of flushing water within the lavatory by capillary action.

The housing 2 includes a conduit 8 for conveying the liquid from the reservoir bottle 6 to the porous pad 7. The conduit 8 comprises an inlet portion 9 of circular cross-section which is sized so as to fit snugly within the circular mouth of the reservoir bottle 6. The inlet portion 9 terminates obliquely, as seen clearly in FIGS. 2 and 3, so as to form an elliptical mouth. The reservoir bottle 6 is sealed by a plastics or foil cap 6', and the act of inserting the inverted reservoir bottle 6 into the housing 2 causes the cap 6' to break, by virtue of the shape of the inlet portion 9 of the conduit 8 so as to permit liquid from the reservoir bottle 6 to fall under gravity into the conduit 8. The inlet portion 9 is provided with a projection in the form of a stud 9' which serves to retain the cap 6' in its open position. It will be appreciated that, in the absence of such a stud, the cap 6' could be forced, but the weight of the liquid remaining in the reservoir bottle 6, to fall back into its original position, thereby preventing further liquid from being dispensed. As can be seen from FIGS. 2, 3 and 4, the stud 9' extends parallel to the axis of the inlet portion 9 and adjoins the inlet portion 9 at its shortest point. The stud 9' is formed integrally with the inlet portion 9. Thus, the extreme end of the inlet portion 9 bears against one side of the cap 6' of the reservoir bottle 6, causing it to break and to pivot about an axis at the opposite side. On fully, inserting the inlet portion 9 into the reservoir bottle 6, the stud 9' is caused to bear against the outer face of the cap 6' so as to prevent it from falling back into its closed position. The stud 9' extends along the complete length of the cylindrical inlet portion 9, for ease of manufacturing, e.g. by moulding.

The conduit 8 further comprises an outlet portion 10 in the form of a cylinder which bears against the porous pad 7. The cross-sectional area of the outlet portion 10 is less than that of the inlet portion 9, and this helps to prevent, or at least minimise the amount of, flushing water entering the reservoir bottle 6.

As can be seen from FIGS. 4(*a*) to 4(*c*), the cylinder of the outlet portion 10 can be D-shaped, circular or rectangular in cross-section, and the outlet portion 10 is partially or totally surrounded by a cylindrical barrier wall 10' of rectangular cross-section, which further acts to prevent ingress of flushing water. In the arrangements shown in FIGS. 4(*a*) and 4(*b*), one of the two long sides of the rectangular cross-section of the barrier wall 10' coincides with a diameter of the circular cross-section of the inlet portion 8 when viewed vertically. This arrangement enables the position of the porous pad 7 to be adjusted so as to ensure that a portion is always in the stream of the flushing water for a wide range of different lavatory bowls, whilst ensuring that the outlet portion 10 of the conduit 8 is effectively closed by the porous pad 7.

In the arrangement shown in FIG. 4(*c*), the centre of the rectangular cross-section of the outlet portion 10 coincides with the centre of the circular cross-section of the inlet portion 9 when viewed vertically. This arrangement is particularly suitable for use in conjunction with the embodiments of the wicking device described below with reference to FIGS. 13(*a*) and 13(*b*) or FIG. 14 or a wicking device in the form of a plate having elongate channels therein.

In the arrangements shown in FIGS. 4(*a*) and 4(*b*), the inlet and outlet portions 9, 10 of the conduit 8 are separated by a membrane provided with a small circular aperture 10".

The manner in which the position of the porous pad 7 can be adjusted by a user is illustrated in FIG. 7. The porous pad 7 is provided with two elongate guide slots 11 which are engaged by two corresponding spring fingers 12 in the housing 2. The guide slots 11 serve to define the two extreme positions of the range of possible positions of the porous pad 7 within the housing 2.

In order to allow air to replace liquid dispensed from the reservoir bottle 6, a series of small vent holes 13, typically 1.3 mm (50/1000 inch) in diameter, are formed in the porous pad 7 and arranged such that, in whatever position of the porous pad 7 within the range defined by the guide slots 11, there is always at least one vent hole 13 communicating air from beneath the porous pad 7 to the mouth of the reservoir bottle 6 via the conduit 8.

The housing 2 is also formed with a comb-shaped series of apertures 14 at the bottom of the front side which allow the flushing water to drain away from above the porous pad 7.

The housing 2 is additionally provided with a number of horizontal rib-like projections 15 for engaging a corresponding horizontal groove (not shown) at the top of the reservoir bottle 6 so as to retain the reservoir bottle 6 in the operative position within the housing 2 once it has been inserted by a user.

The functioning of the adjustable porous pad 7 will now be described with reference to FIGS. 8 and 9. FIG. 8 illustrates the configuration of the dispensing device 1 when used with a lavatory with an open rim. With the dispensing device 1 suspended from the rim 16 of such a lavatory, it can be seen that the stream of flushing water, indicated by the thick arrow, passes through the porous pad 7 when the porous pad 7 is in the fully-inserted position. However, when used with a lavatory of the boxed-rim configuration, as shown in FIG. 9, a longer porous pad is provided. However, it can be seen that, even if this longer porous pad 7 were to remain in its fully-inserted position, the stream of flushing water emanating from the boxed rim 17 would not contact the porous pad 7, and the device would not therefore function optimally. With such a boxed-rim configuration, a longer porous pad is provided, and this is withdrawn to a fully-extended position, as shown in FIG. 9, so as to expose a portion thereof to the stream of flushing water, indicated by the thick arrow, while ensuring that the outlet portion 10 of the conduit 8 is still closed by the inner portion of the porous pad 7. As described above, this is ensured by virtue of the guide slots 11 within the porous pad 7 abutting the spring fingers 12 within the housing 2.

The adjustability of the porous pad is of particular advantage when used either with open rim lavatories or with boxed rim lavatories, since there is a large range of geometries within each type, as illustrated in FIG. 10, which illustrates examples of the various lavatory rim configurations for different countries, and thereby indicting the utility of being able to select the porous pad and also to adjust its position. More specifically, the drawing illustrates the distance between the position of the housing of the liquid dispenser and the stream of flushing water. The cross-hatched area indicates the limited range distances (up to 16 mm (0.625 inch)) for which prior-art liquid dispensers would be suitable, and the single-hatched area indicates the range of distances (up to 22 mm (0.875 inch)) for a single size of porous pad according to the preferred embodiment of the invention. With larger pad sizes, the distance of utility can be extended indefinitely, but in practice, the maximum distance required is about 48 mm (1.9 inches). The bars indicate the range of distances found in different countries, as follows: (a) Australia; (b) United Kingdom; (c) Malaysia; (d) South Africa; (e) France; (f) Italy; (g) Spain; (h) Japan; (i) Thailand; (j) Brazil, Argentina and Mexico; (k) Korea; (l) Philippines; (m) and (n) U.S.A. The vertical line intersecting the bars indicates an approximate dividing line between lavatories of the open-rim construction (to the left of the line) and those of the boxed-rim construction (to the right of the line).

In an alternative arrangement, shown in FIG. 11, the housing 2 is provided with a spillage tray 18 incorporating a vertical vent channel 19 positioned in register with a vent hole 13 in the porous pad 7. This serves the function of collecting any excess liquid while still enabling venting of the reservoir bottle 6.

A first alternative structure of the wicking device is shown in a perspective view in FIG. 12(*a*) and in a cross-sectional view in FIG. 12(*b*). In this embodiment, the wicking device is in the form of a plate 20 having the same over-all shape as that illustrated in FIG. 7, with the elongate guide slots 11 providing adjustability of position of the plate 20 to accommodate different lavatory geometries. However, the plate 20 is not porous but solid apart from a number of raised through-holes 21 formed therein. The holes serve to permit the liquid, when diluted with the flushing water to pass through, in the direction of the clear arrow, and also permit venting of the reservoir bottle 6, as shown by the solid arrow. The holes are sufficiently small to prevent the undiluted liquid from passing through.

A second alternative structure of the wicking device is shown in a perspective view in FIG. 13(*a*) and in a cross-sectional view in FIG. 13(*b*). As with the first alternative structure described above with reference to FIGS. 12(*a*) and (*b*), the wicking device is in the form of a plate 22 having the same over-all shape as that illustrated in FIG. 7, with the elongate guide slots 11 providing adjustability of position of the plate 22 to accommodate different lavatory geometries. In this embodiment, the plate 22 is again non-porous but solid apart from a number of elongate slots 23 formed therein in a generally parallel but splayed configuration. The slots 23 permit the liquid, when diluted with the flushing water to pass through, in the direction of the clear arrow, and also permit venting of the reservoir bottle 6, as shown by the solid arrow. The slots 23 are sufficiently small to prevent the undiluted liquid from passing through.

Third and fourth alternative structures of the wicking device are shown in perspective views in FIGS. 14(*a*) and (*b*) respectively. As with the second alternative structure described above with reference to FIGS. 13(*a*) and (*b*), the wicking device is in the form of a non-porous plate 24, 24' having the same over-all shape as that illustrated in FIG. 7, with the elongate guide slots 11 providing adjustability of position of the plate 24, 24' to accommodate different lavatory geometries and having a number of elongate slots 25, 25' formed therein. In the arrangement shown in FIG. 14(*a*), the slots 25 are arranged in a parallel fashion and not splayed. Furthermore, a recess 26 is formed within the plate 24 to accommodate the top of the inverted reservoir bottle 6. In the arrangement shown in FIG. 14(*b*), the slots 25' are arranged in a splayed fashion which enables the liquid to be conveyed from the reservoir in divergent paths. In this arrangement, a T-shaped recess 26' is formed in the plate, but there are no capillary channels in this recess. The recess 26' is formed such that the leg of the "T" is slightly shallower than the bar of the "T", as can be seen from FIG. 14(*b*). The leg serves as a vent for air. In the structures for the wicking device, the arrangement is such that the plates 22, 24, 24', 27 may be retained in a substantially fixed position when in use in the lavatory bowl. Also, the plates 22, 24, 24', 27 may be retained in a generally horizontal plane when in use in the lavatory bowl. The plates 22, 24, 24', 27 have a first portion for receiving liquid from the reservoir 6 and a second portion intended to be positioned within the stream of flushing water. The second portion of the plates 22, 24, 24', 27 may terminate in a curved edge.

A fifth alternative structure of the wicking device is shown in a perspective view in FIG. 15(*a*) and in a cross-sectional view in FIG. 15(*b*). As with the second, third and fourth alternative structures described above with reference to FIGS. 13(*a*) and (*b*) and FIGS. 14(*a*) and (*b*), the wicking device is in the form of a non-porous plate 27 having the same over-all shape as that illustrated in FIG. 7 and having a number of elongate slots 28 formed therein. In this embodiment, the slots 28 are arranged generally in a parallel fashion but form a tapered geometry in the region of the mouth of the reservoir bottle 6. The plate 27 comprises a venting post 29 which mates with the mouth of the reservoir bottle 6 in use so as to provided a vent channel. The venting post 29 is provided with a number of radial fins 30 which define conduits for the liquid between the reservoir bottle 6 and the plate 27. As with FIGS. 12(*b*) and 13(*b*), the flow of liquid and the venting are indicated by the clear and solid arrows respectively. It will be appreciated that, with this embodiment, a separate plate 27 will need to be provided for each different geometry of lavatory rim.

In the preferred embodiment, and in the alternative embodiments described above, the venting has been achieved through the wicking device. However, the invention extends to arrangements wherein the venting is achieved in a more direct fashion by providing a venting aperture in the reservoir bottle itself, in addition to the mouth of the reservoir bottle through which the liquid is dispensed.

In a first alternative venting arrangement, as shown in a perspective view in FIG. 16(*a*) and in a cross-sectional view in FIG. 16(*b*), the top face of the reservoir bottle 31 is provided with a one-way valve in the form of a duck-bill valve 32. This permits air to pass into the reservoir bottle 31 when the pressure difference between the inside of the bottle and the outside reaches a predetermined level.

In a second alternative venting arrangement, as shown in a perspective view in FIG. 17(*a*) and in cross-sectional views in FIGS. 17(*b*) and (*c*), the top face of the reservoir bottle 33 is provided with a plug 34 which seals an aperture 35 within the reservoir bottle 33, and the housing 36 is provided with a corresponding pin 37 positioned such that, when a user inserts the reservoir bottle 33 into the housing 36, in the direction indicated in FIG. 17(*b*) by the clear arrow, the pin 37 bears on the plug 34, in the direction indicated by the solid arrow in FIG. 17(*c*), and releases it into the reservoir bottle 33, as shown in FIG. 17(*c*). The pin 37 is sized in relation to the aperture 35 so as to provide a vent channel between the pin 37 and the aperture 35.

In a third alternative venting arrangement, as shown in a perspective view in FIG. 18(*a*) and in cross-sectional views in FIGS. 18(*b*) and (*c*), the top face of the reservoir bottle 38 is provided with a breakable seal 39 which covers an aperture 40 within the reservoir bottle 38, and the housing 41 is provided with a corresponding tube member 42 positioned and dimensioned such that, when a user inserts the reservoir bottle 38 into the housing 41, in the direction indicated by the clear arrow in FIG. 18(*b*), the tube member 42 bears on the seal 39, in the direction indicated by the solid arrow in FIG. 18(*c*), releases it into the reservoir bottle 38 and seals the aperture 40, as shown in FIG. 18(*c*). A venting channel is thus provided along the bore of the tube member 42. The end of the tube member 42 is chamfered for ease of location within the aperture 40.

In a fourth alternative venting arrangement, as shown in a perspective view in FIG. 19(*a*) and in a cross-sectional view in FIG. 19(*b*), the top of the reservoir bottle 43 is provided with a venting aperture 44 distinct from, but proximate to, the mouth 45 of the reservoir bottle 43. Both the venting aperture 44 and the mouth 45 of the reservoir bottle 42 are sealed prior to use with a breakable seal (not shown). The housing 46 is provided with a post 47 positioned and dimensioned such that, when a user inserts the reservoir bottle 43 into the housing 46, in the direction indicated by the clear arrow in FIG. 19(*a*), the post 47 breaks the seal and is inserted in the venting aperture 44 seals the aperture 40, as shown in FIG. 19(*b*). A venting channel is thus provided along the bore of the post 47.

In a fifth alternative venting arrangement, as shown in perspective views in FIGS. 20 (*a*) and (*b*), the top of the reservoir bottle 48 is provided with a venting hole 49 covered by a removable tab 50, which is arranged to be broken away from the reservoir bottle 48 by a user, by manipulation as indicated by the clear arrows in FIG. 20(*a*), prior to inserting the reservoir bottle 48 in the housing 51, as shown in FIG. 20(*b*). In a variant of this embodiment, as shown in a cross-sectional view in FIG. 20(*c*), the housing 51 is provided with a ramp projection 52 which is positioned so as automatically to remove the tab 50 a user inserts the reservoir bottle 48 in the housing 51.

The invention has been described above in relation to preferred embodiments. However, many variations and modifications will be apparent to those skilled in the art, and the scope of the invention is defined solely by the claims appended hereto.

For example, although the wicking device in the preferred embodiments has been described as comprising a porous pad or a plate having circular or elongate apertures therethrough, the wicking device could alternatively comprise a plate having elongate channels therein, and the liquid would be dispensed from these channels by virtue of the flushing water displacing the liquid from the channels.

In addition, although the preferred embodiments concern arrangements for dispensing liquid from the rim of a lavatory, the invention could also be applied to arrangements for releasing an insecticide or an air freshener into the atmosphere.

What is claimed is:

1. A dispensing device for dispensing a liquid from a rim of a toilet bowl, the device comprising:

a reservoir for holding the liquid;

a housing for holding the reservoir, the housing including a wicking device for conveying liquid to be dispensed from the reservoir to a position within the stream of flushing water, the wicking device comprising a plate having channels formed therein; and means for suspending the housing from the rim of the toilet bowl, wherein the channels are arranged in a substantially parallel fashion.

2. The dispensing device of claim 1 wherein:

the plate is retained in a substantially fixed position when in use in the toilet bowl.

3. The dispensing device of claim 2 wherein:

the plate is retained in a generally horizontal plane.

4. The dispensing device of claim 1 wherein:

the plate has a first portion for receiving liquid from the reservoir and a second portion intended to be positioned within the stream of flushing water.

5. The dispensing device of claim 1 wherein:

the plate is non-porous.

6. The dispensing device of claim 5 wherein:

the plate includes a recess extending transversely to the direction of the channels.

7. The dispensing device of claim 6 wherein:

the recess communicates with the channels.

8. The dispensing device of claim 1 wherein:

the plate further comprises a projection for insertion in a mouth of the reservoir.

9. A dispensing device for dispensing a liquid from a rim of a toilet bowl, the device comprising:

a reservoir for holding the liquid;

a housing for holding the reservoir, the housing including a wicking device for conveying liquid to be dispensed from the reservoir to a position within the stream of flushing water, the wicking device comprising a plate having channels formed therein; and means for suspending the housing from the rim of the toilet bowl, wherein the channels are arranged in a splayed fashion.

10. The dispensing device of claim 9 wherein:

the plate is retained in a substantially fixed position when in use in the toilet bowl.

11. The dispensing device of claim 10 wherein:

the plate is retained in a generally horizontal plane.

12. The dispensing device of claim 9 wherein:

the plate has a first portion for receiving liquid from the reservoir and a second portion intended to be positioned within the stream of flushing water.

13. The dispensing device of claim 9 wherein:

the plate is non-porous.

14. The dispensing device of claim 13 wherein:

the plate includes a recess extending transversely to the direction of the channels.

15. The dispensing device of claim 14 wherein:

the recess communicates with the channels.

16. The dispensing device of claim 9 wherein:

the plate further comprises a projection for insertion in a mouth of the reservoir.

17. A dispensing device for dispensing a liquid from a rim of a toilet bowl, the device comprising:

a reservoir for holding the liquid;

a housing for holding the reservoir, the housing including a wicking device for conveying liquid to be dispensed from the reservoir to a position within the stream of flushing water, the wicking device comprising a plate having channels formed in an upper surface of the plate; and means for suspending the housing from the rim of the toilet bowl, wherein the plate is retained in a substantially fixed position when in use in the toilet bowl.

18. The dispensing device of claim 17 wherein:

the plate is non-porous.

19. The dispensing device of claim 17 wherein:

the plate includes a recess extending transversely to the direction of the channels and the recess communicates with the channels.

20. The dispensing device of claim 17 wherein:

the reservoir has a mouth and a frangible seal to cover the mouth, the seal being broken when the reservoir is placed in the housing.

21. The dispensing device of claim 20 wherein:

the plate further comprises a projection for insertion in the mouth of the reservoir.

22. A dispensing device for dispensing a liquid from a rim of a toilet bowl, the device comprising:

a reservoir for holding the liquid;

a housing for holding the reservoir, the housing including a wicking device for conveying liquid to be dispensed from the reservoir to a position within the stream of flushing water, the wicking device comprising a non-porous plate having channels formed therein; and means for suspending the housing from the rim of the toilet bowl, wherein the plate is retained in a substantially fixed position when in use in the toilet bowl.

23. The dispensing device of claim 22 wherein:

the plate includes a recess extending transversely to the direction of the channels and the recess communicates with the channels.

24. The dispensing device of claim 22 wherein:

the reservoir has a mouth and a frangible seal to cover the mouth, the seal being broken when the reservoir is placed in the housing.

25. The dispensing device of claim 24 wherein:

the plate further comprises a projection for insertion in the mouth of the reservoir.

26. A dispensing device for dispensing a liquid from a rim of a toilet bowl, the device comprising:

a reservoir for holding the liquid, the reservoir having a mouth and a frangible seal to cover the mouth;

a housing for holding the reservoir, the frangible seal being broken when the reservoir is placed in the housing, the housing including a wicking device for conveying liquid to be dispensed from the reservoir to a position within the stream of flushing water, the wicking device comprising a plate having channels formed therein; and means for suspending the housing from the rim of the toilet bowl, wherein the plate further comprises a projection for insertion in the mouth of the reservoir.

27. The dispensing device of claim 26 wherein:

the plate is non-porous.

28. The dispensing device of claim 26 wherein:

the plate is retained in a substantially fixed position when in use in the toilet bowl.

29. A liquid-dispensing device arranged to be suspended from a rim of a lavatory, the device comprising:

a liquid reservoir having a mouth and a closure member arranged, when in its closed position to seal the mouth and which can be moved into an open position, in which liquid can be dispensed from the reservoir;

opening means for causing the closure member to be so moved into said open position; and means for retaining said closure member in its open position, wherein said closure member is substantially rigid and arranged to be pivoted between said open and closed positions about one side thereof.

30. A device as claimed in claim 29, wherein the angle through which said closure member is moved between said open and closed positions is substantially 90 degrees.

31. A device as claimed in claim 29, wherein said opening means comprises a projection arranged to bear on a side of the closure member generally opposite to said one side.

32. A device as claimed in claim 31, wherein said retaining means comprises a second projection arranged to bear on a face of the closure member when in its open position.

33. A device as claimed in claim 32, wherein said closure member is substantially circular and said opening means and said retaining means are disposed at diametrically opposed positions in relation to the closure member.

34. A device as claimed in claim 33, wherein said opening means and said retaining means are formed on a substantially circular obliquely truncated cylinder which is arranged to be inserted into the mouth of the reservoir to cause the closure member thereof to move into its open position.

35. A device as claimed in claim 34, wherein said opening means comprises the end portion of the obliquely truncated cylinder.

36. A device as claimed in claim 34, wherein said retaining means comprises a projection from the cylinder.

37. A device as claimed in claim 36, wherein said projection comprises a stud.

38. A device as claimed in claim 34, wherein the cylinder and the reservoir mouth are so dimensioned as to form a substantially liquid-tight seal when the cylinder is inserted in the reservoir mouth.

39. A device as claimed in claim 29 wherein the opening means and the retaining means form part of a housing for the reservoir.

40. A device as claimed in claim 39, wherein said housing comprises means for suspending the device such that, when the opening means and the retaining means are inserted in the reservoir mouth, the reservoir is supported in an inverted position with the mouth lowermost, such that the liquid can be dispensed from the reservoir.

41. A dispensing unit for dispensing a liquid from a rim of a lavatory bowl, the unit comprising:

a housing containing a wicking device for conveying liquid to be dispensed from a reservoir to a position within the stream of flushing water, wherein the unit is so structured as to permit the position of the wicking device to be adjusted between different positions so as to function with lavatory bowls with different shapes and different flushing systems.

42. A dispensing unit as claimed in claim 41, wherein the wicking device is provided with at least one venting aperture.

43. A dispensing unit as claimed in claim 42, wherein the wicking device is provided with at least one venting aperture positioned such that there is at least one functioning venting hole for every possible functional position of the adjustable wicking device.

44. A dispensing unit as claimed in claim 42, further comprising a spillage tray positioned in use below the wicking device, and having formed therein a vent channel arranged in communication with at least one functioning venting aperture.

45. A dispensing unit as claimed in claim 42 wherein said at least one venting aperture comprises one or more substantially circular holes.

46. A dispensing unit as claimed in claim 42, wherein said at least one venting aperture comprises one or more elongate slits.

47. A dispensing unit as claimed in claim 41, further comprising a conduit for conveying liquid from the reservoir to the wicking device.

48. A dispensing unit as claimed in claim 47, wherein the conduit comprises a cylindrical inlet portion of substantially circular cross-section for engaging a circular mouth of a bottle constituting the reservoir.

49. A dispensing unit as claimed in claim 48, wherein the inlet portion terminates obliquely so as to define a substantially elliptical aperture.

50. A dispensing unit as claimed in claim 48, wherein the conduit further comprises a substantially cylindrical outlet portion having a cross-sectional area substantially less than that of the inlet portion.

51. A dispensing unit as claimed in claim 50, wherein the inlet portion of the conduit is laterally displaced from the outlet portion.

52. A dispensing unit as claimed in claim 50, wherein the substantially cylindrical outlet portion has a substantially D-shaped cross-section.

53. A dispensing unit as claim 50, in claim wherein the substantially cylindrical outlet portion has a substantially circular cross-section.

54. A dispensing unit as claimed in claim 50, wherein the substantially cylindrical outlet portion has a substantially rectangular cross-section.

55. A dispensing unit as claimed in claim 50, wherein the housing further comprises a cylindrical barrier member at least partially surrounding the outlet portion of the conduit to act as a barrier against water ingress into the reservoir.

56. A dispensing unit as claimed in claim 55, wherein the barrier member is substantially rectangular in cross-section.

57. A dispensing unit as claimed in claim 56, wherein one of the two long sides of the substantially rectangular cross-section of the barrier member coincides with a diameter of the substantially circular inlet portion of the conduit when viewed in longitudinal cross-section.

58. A dispensing unit as claimed in claim 50, and structured such that the outlet portion of the conduit bears against the wicking device so as to create a substantially liquid-tight seal therebetween.

59. A dispensing unit as claimed in claim 41, wherein the wicking device comprises a first portion for receiving liquid from the reservoir and a second portion arranged to be positioned in use in a dispensing position.

60. A dispensing unit as claimed in claim 59, wherein the second portion is arranged to be positioned in use within the stream of flushing water.

61. A dispensing unit as claimed in claim 60, wherein the second portion is arranged to be positioned in use between the first portion and the rim of the lavatory bowl.

62. A dispensing unit as claimed in claim 58, wherein the unit is structured so as to permit the position of the wicking device to be adjusted by sliding the first portion thereof against the outlet portion of the conduit.

63. A dispensing unit as claimed in claim 41, wherein the wicking device is substantially laminar.

64. A dispensing unit as claimed in claim 63, wherein the laminar wicking device is formed with a depression for receiving a neck of a bottle constituting said reservoir.

65. A dispensing unit as claimed in claim 63, wherein the wicking device is formed with one or more elongate apertures and the housing comprises a corresponding one or more projections for engaging the elongate apertures so as to define an outermost possible operative position of the wicking device.

66. A dispensing unit as claimed in claim 65, wherein said one or more projections each comprises a spring finger which is arranged to engage its corresponding aperture in the wicking device when the wicking device is inserted into the housing.

67. A dispensing unit as claimed in claim 63, wherein the wicking device comprises a projection for insertion in the mouth of said reservoir in use, the projection having formed therethrough a vent channel.

68. A dispensing unit as claimed in claim 41, wherein the wicking device comprises a porous pad.

69. A dispensing unit as claimed in claim 41, wherein the wicking device comprises a plate with channels formed therein.

70. A dispensing unit as claimed in claim 69, wherein said channels are arranged in a splayed configuration thereby to convey the liquid from the reservoir in divergent paths.

71. A dispensing unit as claimed in claim 41, wherein the wicking device comprises a plate with substantially circular holes formed therein.

72. A dispensing unit as claimed in claims, further comprising means for suspending the unit from the rim of a lavatory bowl.

73. A dispensing unit as claimed in claim 48, wherein the bottle comprises an opening for dispensing the liquid therefrom, the opening having a substantially circular cross-section greater than that of the inlet portion of the conduit.

74. A dispensing unit as claimed in claim 73, wherein the opening and the inlet portion of the conduit are so dimensioned as to form a substantially liquid-tight seal when the inlet portion is inserted into the opening.

75. A dispensing unit as claimed in claim 73, wherein the mouth of the bottle is covered prior to use with a frangible seal which is arranged to be broken in use by compressing the seal against the cylindrical inlet portion of the conduit.

76. A dispensing unit as claimed in claim 75, wherein the cylindrical inlet portion of the conduit comprises opening means for causing the frangible seal to be so broken and retaining means for retaining the frangible seal in a position which does not block the mouth of the bottle.

77. A dispensing unit as claimed in claim 76, wherein the frangible seal is substantially rigid and arranged to be pivoted between its open and closed positions about one side thereof.

78. A dispensing unit as claimed in claim 77, wherein the angle through which the frangible seal is moved between said open and closed positions is substantially 90 degrees.

79. A dispensing unit as claimed in claim 77, wherein said opening means comprises a projection arranged to bear on the side of the frangible seal generally opposite to said one side.

80. A dispensing unit as claimed in claim 79, wherein said retaining means comprises a further projection arranged to bear on a face of the frangible seal when in its open position.

81. A dispensing unit as claimed in claim 80, wherein the frangible seal is substantially circular and staid opening means and said retaining means are disposed at diametrically opposed positions in relation to the frangible seal.

82. A dispensing unit as claimed in claim 81, wherein said opening means and said retaining means are formed on a substantially circular obliquely truncated cylinder which is arranged to be inserted into the mouth of the bottle to cause the frangible seal to move into its open position.

83. A dispensing unit as claimed in claim 82, wherein said opening means comprises the end portion of the obliquely truncated cylinder.

84. A dispensing unit as claimed in claim 82, wherein said retaining means comprises a projection from the cylinder.

85. A dispensing unit as claimed in claim 84, wherein said projection comprises a stud.

86. A dispensing unit for dispensing a liquid from a rim of a lavatory bowl, the unit comprising:

a housing containing a wicking device for conveying liquid to be dispensed from a reservoir to a position within the stream of flushing water, wherein the wicking device is non-porous and is provided with at least one venting aperture which in use communicates between ambient air and the reservoir so as to enable air to displace liquid dispensed from the reservoir.

87. A dispensing unit as claimed in claim 86 wherein said at least one venting aperture comprises one or more substantially circular holes.

88. A dispensing unit as claimed in claim 86, wherein said at least one venting aperture comprises one or more elongate slits.

89. A dispensing unit as claimed in claim 86, wherein the unit is so structured as to permit the position of the wicking device to be adjusted between different positions so as to function with lavatory bowls with different shapes and different flushing systems.

90. A dispensing unit for dispensing a liquid from a rim of a lavatory bowl, the unit comprising:

a reservoir bottle having a mouth; and a wicking device for conveying liquid to be dispensed from the reservoir bottle to a position within the stream of flushing water, wherein the reservoir bottle is provided with venting means other than the mouth for permitting ambient air to enter the bottle to displace liquid dispensed therefrom.

91. A dispensing unit as claimed in claim 90, wherein said venting means comprises a one-way valve.

92. A dispensing unit as claimed in claim 91, wherein said one-way valve comprises a duck-bill valve.

93. A dispensing unit as claimed in claim 90, wherein said venting means comprises a removable plug and said unit comprises a co-operating projection which is positioned so as to remove the plug when the reservoir bottle is placed by a user in its operative position in relation to the unit, thereby to create a venting aperture in the reservoir bottle.

94. A dispensing unit as claimed in claim 90, wherein said venting means comprises a removable seal and said unit comprises a co-operating hollow projection which is positioned so as to remove the seal and project into the reservoir bottle when the reservoir bottle is placed by a user in its operative position in relation to the unit, the hollow projection constituting a venting channel.

95. A dispensing unit as claimed in claim 90, wherein said venting means comprises an air vent in the reservoir bottle which is sealed by a cover portion which can be removed by a user prior to use.

96. A dispensing unit as claimed in claim 90, wherein said venting means comprises an air vent in the reservoir bottle which is sealed by a cover portion, and wherein the unit comprises a projection arranged so as to remove the cover portion when the reservoir bottle is placed by a user in its operative position in relation to the unit.

97. A dispensing unit for dispensing a liquid from a rim of a lavatory bowl, the unit comprising:

a housing containing a wicking device for conveying liquid to be dispensed from a reservoir to a position within the stream of flushing water, wherein the wicking device is in the form of a plate with elongate slots formed in an upper surface of the plate; and means for suspending the housing from said rim of the lavatory bowl, wherein the plate is retained in a substantially fixed position when in use in the lavatory bowl.

98. A dispensing unit as claimed in claim 97, wherein the plate is so retained in a generally horizontal plane.

99. A dispensing unit as claimed in claim 97, wherein the plate has a first portion for receiving liquid from said reservoir and a second portion intended to be positioned within the stream of flushing water, wherein the second portion of the plate terminates in a curved edge.

100. A dispensing unit as claimed in claim 99, wherein the second portion of the plate is formed with a wall.

101. A dispensing unit as claimed in claim 97, wherein the plate has a first portion for receiving liquid from said reservoir and a second portion intended to be positioned within the stream of flushing water, wherein the second portion of the plate is formed with a wall.

102. A dispensing unit as claimed in claim 97, wherein the elongate slots are arranged in a substantially parallel fashion.

103. A dispensing unit as claimed in claim 97, wherein the plate is formed with a recess extending transversely to the direction of the elongate slots.

104. A dispensing unit as claimed in claim 103, wherein the recess communicates with the elongate slots.

105. A dispensing unit as claimed in claim 103, wherein the bottom of the recess is substantially planar.

106. A dispensing unit as claimed in claim 103, wherein the bottom of the recess has no capillary channels formed therein.

107. A dispensing unit as claimed in claim 97, wherein the plate further comprises a projection for insertion in the mouth of said reservoir.

108. A dispensing unit as claimed in claim 107, wherein the projection is in the form of a post provided with a plurality of radial fins which define conduits for the liquid between the reservoir and the plate.

* * * * *

UNITED STATES PATENT AND TRADEMARK OFFICE

CERTIFICATE OF CORRECTION

PATENT NO. : 6,505,356 B1 
DATED : January 14, 2003
INVENTOR(S) : Stephen B. Leonard et al.

It is certified that error appears in the above-identified patent and that said Letters Patent is hereby corrected as shown below:

Column 14,
Line 62, "as claim 50, in claim" should read -- as claimed in claim 50, --.

Column 15,
Line 61, "claims," should read -- claim 41, --.

Column 16,
Line 30, "staid" should read -- said --.

Signed and Sealed this

Twenty-third Day of September, 2003

JAMES E. ROGAN
*Director of the United States Patent and Trademark Office*